United States Patent [19]

Wanner

[11] Patent Number: 4,602,689

[45] Date of Patent: Jul. 29, 1986

[54] POWER TOOL

[75] Inventor: Karl Wanner, Leinfelden-Echterdingen, Fed. Rep. of Germany

[73] Assignee: Robert Bosch GmbH, Stuttgart, Fed. Rep. of Germany

[21] Appl. No.: 230,590

[22] Filed: Feb. 2, 1981

[30] Foreign Application Priority Data

Mar. 19, 1980 [DE] Fed. Rep. of Germany ..... 3010479

[51] Int. Cl.[4] ..... B25D 9/06

[52] U.S. Cl. ..... 173/127; 173/116; 173/131; 173/139; 92/248

[58] Field of Search ..... 173/116, 117, 126, 127, 173/131, 134, 139; 92/248, 249, 250, 251, 252, 253, 254

[56] References Cited

U.S. PATENT DOCUMENTS

| | | | |
|---|---|---|---|
| 1,820,878 | 8/1931 | Wyckoff | 92/248 X |
| 1,904,070 | 4/1933 | Morgan | 92/248 X |
| 2,817,562 | 12/1957 | Fleming et al. | 92/249 X |
| 2,895,773 | 7/1959 | McConnaughey | 92/249 X |
| 3,114,421 | 12/1963 | McCloud | 173/127 X |
| 3,176,595 | 4/1965 | Schwartz | 92/249 X |
| 3,730,060 | 5/1973 | DeCarbon | 92/249 |
| 3,874,382 | 4/1975 | Nogrer et al. | 92/249 X |

*Primary Examiner*—Robert P. Olszewski

*Attorney, Agent, or Firm*—Michael J. Striker

[57] ABSTRACT

A power tool, particularly a hand-held power tool, has a striking mechanism with a striker transmitting impact energy to a tool, a drive operative for actuating the striker through an air cushion, and a heat insulating element which is associated with the striker and insulates the same from heat generated in the air cushion during the operation of the power tool. The heat insulating element may simultaneously be formed as a mechanical buffer.

6 Claims, 3 Drawing Figures

POWER TOOL

BACKGROUND OF THE INVENTION

The present invention relates to a power tool, and more particularly to a hand-held power tool which has a striking mechanism operable through an air cushion.

Power tools of the above-mentioned general type are known in the art. One such power tool is described, for example, in the U.S. Pat. No. 2,283,292. In the known power tools as well as in the power tool disclosed in the above-mentioned patent, the striker is constituted of steel. During operation of the power tool heat is generated in the air cushion and a part of this heat is transmitted to the striker which possesses high heat conductive properties. This energy is lost for performing of the impact work. It is understood that such a construction contradicts the principle of optimization of the output of power tools.

SUMMARY OF THE INVENTION

Accordingly, is an object of the present invention to provide a power tool in which the above-mentioned disadvantages are eliminated.

More particularly, it is an object of the present invention to provide a power tool which has a noticeably improved output because the heat transfer from the heated air cushion to the striker is considerably reduced in this power tool. Whereas the known power tools are characterized by polithropic change of condition during the compression and subsequent expansion of the air cushion, the power tool in accordance with the invention characterized by approximately adiabatic changes of condition.

In keeping with these objects and with others which will become apparent hereinafter, one feature of the present invention resides, briefly stated, in a power tool having a striking mechanism, an air cushion, and drive means for actuating the striker of the striking mechanism through the air cushion, wherein means for insulating the striker from the heat generated in the air cushion is provided. When the power tool is designed in accordance with the present invention, the above-mentioned disadvantages of the prior art power tools are eliminated and it attains the above-mentioned objects.

The insulating means for insulating the striker from the heat generated in the air cushion may include thermally-insulating buffer means which is arranged on an outer surface of the striker, the outer surface facing toward the air cushion.

In accordance with an especially advantageous feature of the present invention, the buffer means includes a layer of a thermally insulating heat resistant synthetic plastic material.

Still a further feature of the present invention is embodied in the fact that the a lateral surface of the striker which is guided in a guiding means is provided with a thermally insulating jacket means which is advantageous for the purposes of effective heat insulation. The thermally insulating buffer means arranged on the outer surface of the striker and the thermally insulating jacket means arranged on the lateral surface of the striker may together form a one-piece thermally insulating element.

In accordance with an additional feature of the present invention which is advantageous in the sense of heat insulation and manufacture of the power tool, the striker may include a hollow body of a synthetic plastic material, a heavy metal filling accommodated in the hollow body, and a striking member facing toward the tool of the power tool.

Finally, it is also possible to form the heat insulating buffer means as a mechanical buffer between a piston and the striker of the power tool, for which purpose the thermally insulating means is constituted of elastic material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
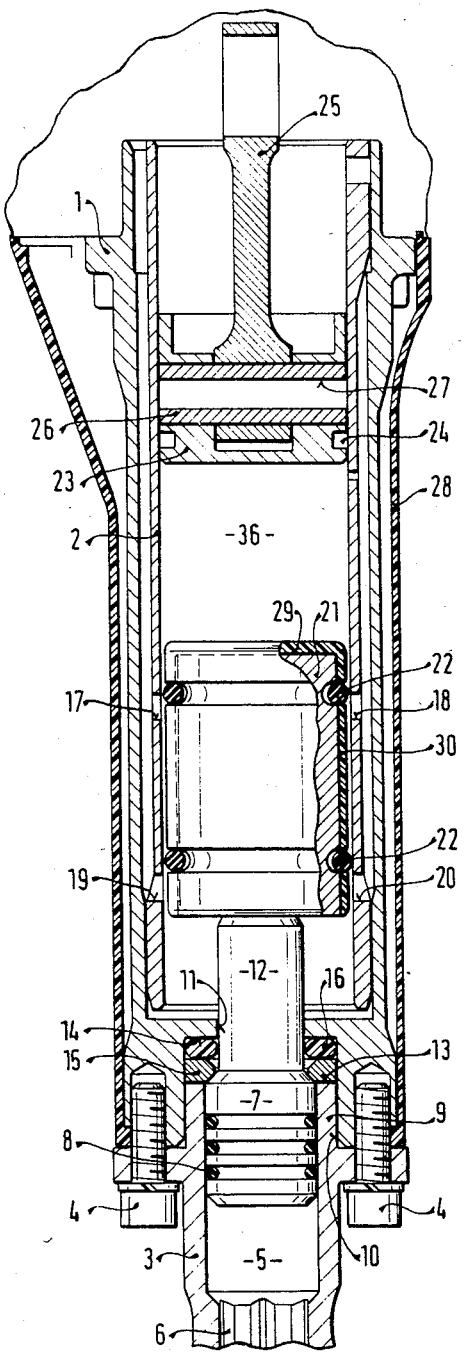
FIG. 1 is a view showing a longitudinal section of a portion of a power tool in accordance with the present invention, including a striker and an air cushion.

FIG. 1 shows a part of a power tool, preferably a hand-held power tool, which is germain to the present invention. The power tool has a housing 1 and a guiding cylinder 2 which is mounted in the housing 1. The housing 1 has a front side in which a tool holder 3 is arranged. The tool holder 3 is connected to the housing 1 by screws 4.

The tool holder 3 has a cylindrical opening 5 and a profiled opening 6 for receiving a shaft of a not-shown tool. The power tool has an anvil 7 having a piston head and provided with sealing rings 8. The piston head of the anvil 7 with the sealing rings 8 are received in the cylindrical opening 5 of the tool holder 3. A cylindrical projection 9 of the tool holder 3 engages in a respective cylindrical opening 10 in the housing 1. The cylindrical opening 10 is stepped and merges into an opening 11 of a smaller cross-section. A neck 12 of the anvil 7 extends through the opening 11 into the interior of the guiding cylinder 2.

The rear end face 13 of the cylindrical projection 9 of the tool holder 3 and a front end face 14 formed by a shoulder between the openings 10 and 11, together bound a space in which a disc 15 and an elastic ring 16 are inserted. The disc 15 is formed to abut against a shoulder between the neck 12 and the piston head of the anvil 7. The neck 12 extends through the openings in the disc 15 and in the elastic ring 16. The interior of the guiding cylinder 2 communicates with the outer air through air ports 17–20.

A striker 21 is received in the guiding cylinder 2 for reciprocation inside the latter. The striker 21 is guided in the inner opening of the guiding cylinder through elastic guiding rings 22. A gap of approximately 1 mm remains between the outer surface of the striker 21 and the inner wall of the guiding cylinder 2. A piston 23 is also arranged in the opening of a guiding cylinder 2. The piston 23 has an outer diameter corresponding to the inner diameter of the opening in the cylinder and thereby a very good guidance of the piston 23 and the guiding cylinder 2 is provided. A sealing ring 24 of the piston 23 closes the interior of the guiding cylinder 2 at the piston side, in air tight manner. Similar air tight closure at the side of the striker 21 is provided by the guiding ring 22 located closer to the piston 23.

The piston 23 is connected with a piston rod 25 by a piston pin 26. The piston pin 26 has an elongated opening 27 which makes the former lighter and more elastic. A coating 28 of synthetic plastic material which is known per se in the art, surrounds and protects the housing 1. The hand-held power tool includes, in addition to the above-mentioned parts, a motor, transmission, switches, conduits, and at least one handle.

The power tool in accordance with the present invention operates with the use of a air cushion which is identified by reference numeral 36. The piston 23 acts during the operation of the power tool upon the striker 21 through the air cushion 36. During the operation of the power tool heat is generated in the air cushion and tends to propagate to neighboring parts, particularly to the striker. In accordance with the invention, means is provided for insulating the striker 21 from the heat generated in the air cushion. The insulating means in FIG. 1 is formed by a heat insulating buffer layer 29 of heat resistant synthetic plastic material. As can be seen from this Figure, the buffer layer 29 is arranged on a surface which faces toward the air cushion 36. The insulating means also includes a jacket 30 which possesses the same properties as the buffer layer 29. As can be seen from FIG. 1, the jacket 30 surrounds the guiding surface of the striker 21, the guiding surface facing toward the guiding cylinder 2.

The buffer layer 29 and the jacket 30 are of one-piece with one another.

Figure 2:
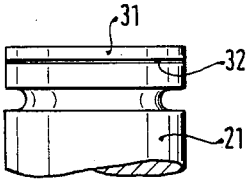
FIG. 2 is a view showing a part of the striker in accordance with another embodiment of the present invention.

The insulating means of the striker 21 shown in FIG. 2 is formed in a somewhat different manner. This means includes a disc 31 of synthetic plastic material which possesses the characteristics of the heat insulating buffer layer 29 of FIG. 1. However, in addition to this characteristics, the disc 31 is elastic so as to form simultaneously a mechanical buffer. The disc 31 is also arranged at a surface which faces toward the air cushion 36 and connected with the striker 21, for example by a layer of glue 32. The disc 31 may also be connected by welding, by pressing the same onto the striker, and the like. A jacket of synthetic plastic material for the striker 21 is not provided in the construction shown in FIG. 2.

Figure 3:
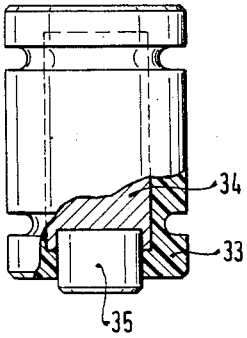
FIG. 3 is a view showing the striker in accordance with still another embodiment of the invention.

The striker shown in FIG. 3 has a hollow body 33 of synthetic plastic material which possesses heat resistant and heat insulating properties. A heavy metal filling 34 is accommodated in the inner hollow of the body 33, and a striking member 35 is provided. The hollow body 33 of heat resistant and heat insulating material form the above-mentioned means for insulating the striker from the heat generated in the air cushion.

In all three embodiments, the inventive power tool is protected against heat losses from the air cushion and operates thereby with improved output.

It will be understood that each of the elements described above, or two or more together, may also find a useful application in other types of constructions, differing from the types described above.

While the invention has been illustrated and described as embodied in a power tool, particularly a hand-held power tool with a striking mechanism operating through an air cushion, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A power tool, particularly a hand-held power tool, having a striking mechanism including a striker arranged for transmitting impact energy to a tool of the power tool; means forming an air cushion in which heat is generated during the operation of the power tool; and drive means for actuating said striker through said air cushion, the improvement comprising heat-insulating means arranged on said striker and formed so as to insulate said striker from the heat generated in said air cushion, said striker includes a hollow body constituted of a thermally-insulating synthetic plastic material and having an inner hollow, an inner filling member constituted of heavy metal and accommodated in said hollow, and a striking member arranged to face toward the tool of the power tool, and said hollow body forms said insulating means.

2. A power tool, particularly, a hand-held power tool, having a striking mechanism including a striker arranged for transmitting impact energy to a tool of the power tool and having an outer surface facing toward said air cushion; means forming an air cushion in which heat is generated during the operation of the power tool; and drive means for actuating said striker through said air cushion, the improvement comprising heat-insulating means arranged on said striker and formed so as to insulate said striker from the heat generated in said air cushion, said insulating means including thermally-insulating buffer means arranged on said surface of said striker, said buffer means arranged on said outer surface of said striker is elastic and soft so as to form simultaneously a mechanical buffer.

3. A power tool as defined in claim 2, wherein said buffer means includes a disc-shaped member arranged on and connected with said outer surface of said striker; and further comprising means for connecting said disc-shaped member with said outer surface of said striker.

4. A power tool as defined in claim 3, wherein said connecting means includes a layer of glue which glues said disc-shaped member to said outer surface of said striker.

5. A power tool as defined in claim 3, wherein said connecting means includes a weld seam by which said disc-shaped member is welded to said outer surface of said striker.

6. A power tool as defined in claim 3, wherein said disc-shaped member is pressed onto said outer surface of said striker so as to form said connecting means.

* * * * *